US011135620B2

(12) United States Patent
Parr et al.

(10) Patent No.: US 11,135,620 B2
(45) Date of Patent: Oct. 5, 2021

(54) AUTONOMOUS DATA COLLECTION AND SYSTEM CONTROL FOR MATERIAL RECOVERY FACILITIES

(71) Applicant: Emerging Acquisitions, LLC, Eugene, OR (US)

(72) Inventors: Christopher Parr, Eugene, OR (US); Thomas Brooks, Eugene, OR (US); James Cole, Eugene, OR (US)

(73) Assignee: EMERGING ACQUISITIONS, LLC, Eugene, OR (US)

( * ) Notice: Subject to any disclaimer, the term of this patent is extended or adjusted under 35 U.S.C. 154(b) by 234 days.

(21) Appl. No.: 16/247,449

(22) Filed: Jan. 14, 2019

(65) Prior Publication Data

US 2019/0217342 A1 Jul. 18, 2019

Related U.S. Application Data

(60) Provisional application No. 62/616,692, filed on Jan. 12, 2018, provisional application No. 62/616,801, filed on Jan. 12, 2018, provisional application No. 62/640,779, filed on Mar. 9, 2018.

(51) Int. Cl.

| | |
|---|---|
| ***B07C 5/36*** | (2006.01) |
| ***B07B 1/14*** | (2006.01) |
| ***B07C 5/342*** | (2006.01) |

(52) U.S. Cl.

CPC ..... *B07C 5/362* (2013.01); *B07B 1/14* (2013.01); *B07C 5/342* (2013.01); *B07C 5/3422* (2013.01); *B07C 5/36* (2013.01); *B07C 2501/0054* (2013.01)

(58) Field of Classification Search

CPC B07C 5/362; B07C 5/342; B07C 5/36; B07C 5/3422; B07C 2501/0054; B07B 1/14

See application file for complete search history.

(56) References Cited

U.S. PATENT DOCUMENTS 3,888,351 A * 6/1975 Wilson ..... B07B 4/08 209/557
5,263,591 A * 11/1993 Taormina ..... B03B 9/06 198/346
7,763,820 B1 * 7/2010 Sommer, Jr. ..... B07C 5/346 209/576

(Continued)

*Primary Examiner* — Patrick H Mackey

(74) *Attorney, Agent, or Firm* — Schwabe Williamson & Wyatt, PC

(57) ABSTRACT

Disclosed embodiments include methods and systems for autonomous data collection and system control of a material recovery or recycling facility. In some embodiments, a central control system receives inputs in the form of at least one data stream from each of one or more environmental sensors that reflect the status of a material recovery facility (MRF). The inputs are used to determine the operating status of one or more components of the MRF, and/or composition of a waste stream being processed by the MRF. At least one material handling unit is controlled in response to the inputs to optimize the recovery and/or purity of recyclable or recoverable materials from the waste stream. A service unit or mechanism may also be controlled in response to the inputs indicating that a component of the MRF requires servicing.

19 Claims, 8 Drawing Sheets

(56) References Cited

U.S. PATENT DOCUMENTS

| | | | | |
|---|---|---|---|---|
| 7,893,378 | B2 † | 2/2011 | Kenny | |
| 8,459,466 | B2 * | 6/2013 | Duffy | B03B 9/06 209/630 |
| 10,137,573 | B2 * | 11/2018 | Davis | B25J 5/04 |
| 2006/0085212 | A1 * | 4/2006 | Kenny | B03B 9/06 705/308 |

* cited by examiner
† cited by third party

AUTONOMOUS DATA COLLECTION AND SYSTEM CONTROL FOR MATERIAL RECOVERY FACILITIES

CROSS-REFERENCE TO RELATED APPLICATIONS

This application claims the priority benefit of the earlier filing date of U.S. Provisional Patent Applications Nos. 62/616,692 and 62/616,801, both filed on 12 Jan. 2018, and No. 62/640,779, filed on 9 Mar. 2018. Each of these applications is hereby incorporated herein by reference in their entireties.

FIELD OF THE INVENTION

This invention relates to management of waste handling facilities. Specifically, disclosed embodiments are directed automated control of solid waste facilities, including sorting recyclable from non-recyclable materials and facilitating the creation of high purity recyclable products with minimal human intervention.

BACKGROUND

Material Recycling or Material Recovery Facilities (MRFs) can separate various types of human-generated solid waste, which may be delivered in a single consolidated waste stream, into recyclable and non-recyclable waste streams in order to reduce land fill use and reuse raw materials for new products. For example, recyclable solid waste materials may include plastic film, paper, old corrugated cardboard (OCC), plastic, aluminum, steel, and glass containers, among other materials. These recyclable materials may be separated from other types of waste that may include wood, concrete, rocks, organic waste etc.

DETAILED DESCRIPTION

Figure 1:
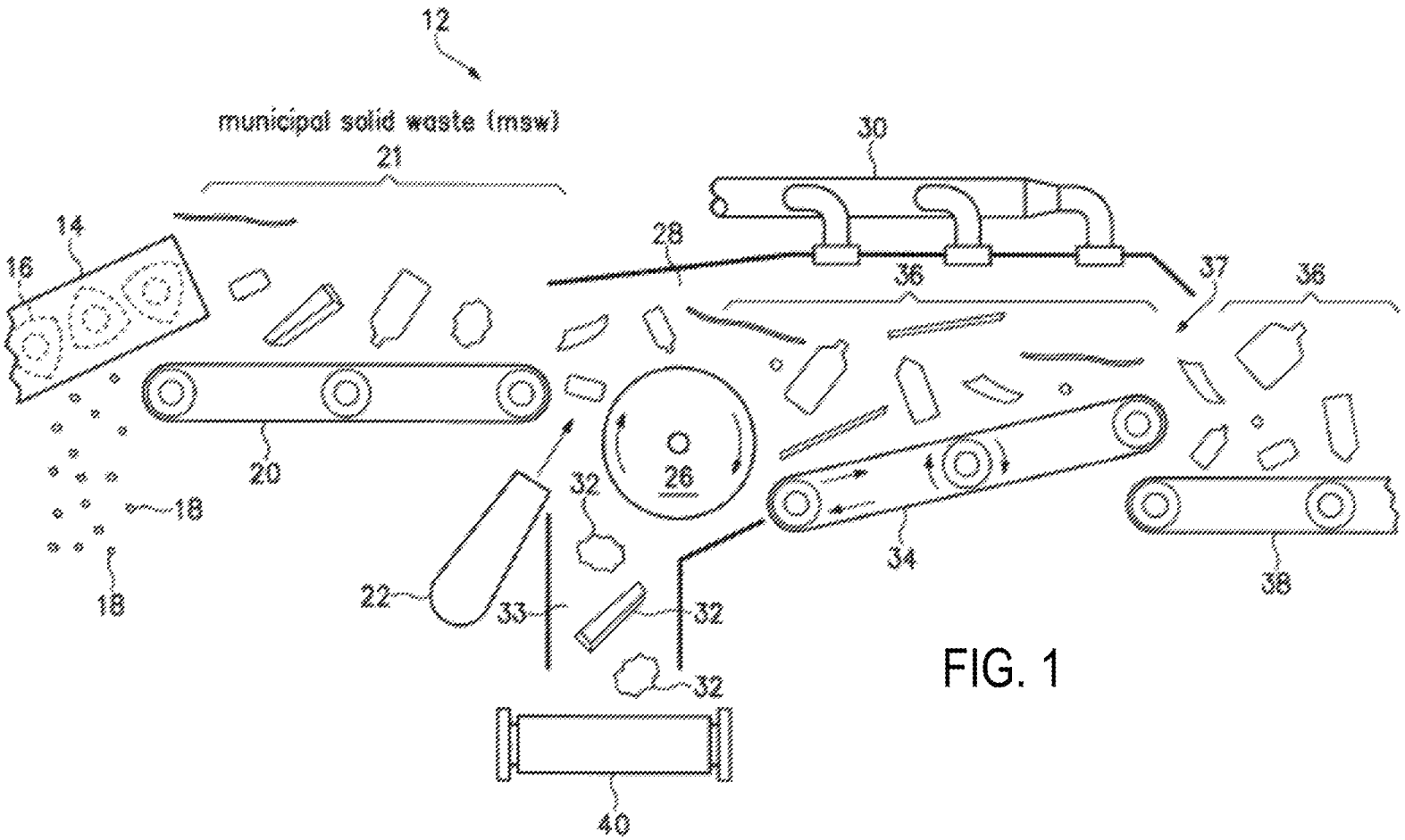
FIG. 1 is a side view of an air separator used for separating recyclable solid waste material from other solid waste material that may be implemented in a MRF, according to various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other, including through electrical communication and feedback circuitry.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Human created waste materials include both two dimensional materials (e.g. paper, films, sheets), and three dimensional objects. The 2D materials can include, but are not limited to, fiber material encompassing newspaper, mixed paper, Old Corrugated Cardboard (OCC), other cardboard and office paper products, plastics, foils, and any other substantially sheet-like materials. The 3D materials are usually relatively light plastic containers, aluminum containers, tin containers and other containers. Such waste materials, collected together, can form a solid waste stream, Most of the material stream can be recovered and recycled, used for making new products, or used for energy sources. As used herein, "recoverable", "recovered", "recyclable", "recycled", "reusable", and "reused" all connote essentially the same idea: a solid waste material that has a potentially economically valuable use or uses following disposal other than being shipped to a landfill.

However, a solid waste stream, such as may come from a municipality, from residential and/or commercial settings, co-mingled residential and commercial recycling, secondary commodity recycling, engineered fuel applications, organic waste, compostable waste, construction waste, industrial waste and/or any other source of solid waste that may include materials useful for secondary purposes, often also includes contaminants such as debris, and other materials that have no feasible reuse and so need to be disposed in a landfill or other suitable disposal facility. These contaminants, if present with recoverable materials, can prevent reuse of the recoverable materials and instead result in recoverable materials being disposed with the contaminants. Thus, the ability of a material recovery facility to separate by size, physical characteristic and chemical makeup is vital to limiting the amount of contaminants found in the final recovered commodity, maximizing the amount of commodity that can be recovered, and minimizing the amount of material that is sent to a landfill.

It will be understood that 2D or two dimensional objects are, in fact, three-dimensional in nature. As used herein, "2D" and "two-dimensional" refer to objects that are substantially flat, where the length and width dimensions substantially outweigh the depth dimension and/or the depth dimension is negligible and so can effectively be disregarded.

For many applications, disc or ballistic screens are used in the materials handling industry for processing large flows of materials, and classifying what is normally considered debris or residual materials from recoverable commodities. However, the recyclable materials may need to be separated from other types of waste that have similar sizes and/or shapes. Thus, existing screening systems that separate materials solely according to size may not effectively separate certain solid waste recyclable materials.

It also may be desirable to separate different plastic films, such as garbage bags, from fiber material, such as paper and cardboard. However, all of these solid waste materials are relatively flat, thin and flexible. These different plastic and fiber materials are all relatively thin and light weight and have a wide variety of different widths and lengths. Even objects that are the same material can take different shapes and sizes by the time they arrive at the recycling center. This creates the need for a system that can also separate the materials according to density and chemical makeup.

Further still, a modern MRF that handles solid waste may need to change the targeted commodities on a day to day, or even minute to minute, basis. This can be done by adjusting the mechanical and automated sorters as well as communication with the plant staff. The values of the recovered materials can vary greatly depending on the nature and amount of contamination. Current processes rely on a certain amount of human sorters to clean the commodities and remove prohibitive objects, with the amount of manpower required being proportional to the system throughput of the MRF, and contaminant amount of the solid waste stream to be processed.

MRF, as used herein, connotes any facility that can accept a solid waste stream for processing to separate recoverable materials from non-recoverable materials. As will be appreciated, the particular configuration and equipment of a given MRF may vary depending upon the specific waste stream intended to be processed by the MRF, as well as the intended recipient(s) of the final recovered material stream or streams. In some examples, a MRF may supply at least one recovered material stream and a residual stream, where the residual stream may include other recoverable materials for which the MRF is not equipped to process. In other examples, a single MRF may be able to output multiple streams of recoverable materials, with a final residual stream comprised (nearly) entirely of unusable materials to be sent to a landfill or other suitable final disposal facility. Disclosed embodiments are intended to be applicable to any and all such configurations.

Embodiments disclosed herein allow for automated and intelligent sorting and cleaning of recyclable waste streams resulting from initial mechanical separation via air and/or screen. By using a combination of one or more of size, density, shape characterizations, visual and/or infrared identification, and automated quality control stations, human staffed positions can be minimized and the plant can be dynamically configured to accommodate waste streams of a fluctuating nature and composition, thereby allowing the plant to be operated more efficiently over longer periods of time. Moreover, disclosed embodiments employ techniques such as machine vision and object recognition, potentially fed by different sensor technologies such as IR, UV, visible light, magnetic, chemical, and similar such sensors, to increase separation accuracy (either in initial air separation or in subsequent processing of recyclable streams following initial separation) to further purify and/or maximize recovery of separated recyclable waste streams. This increased purity thus can result in a more valuable recyclable waste stream, while increased recovery can result in a greater amount of recovered recyclable materials, likewise increasing its overall value.

Figure 2:
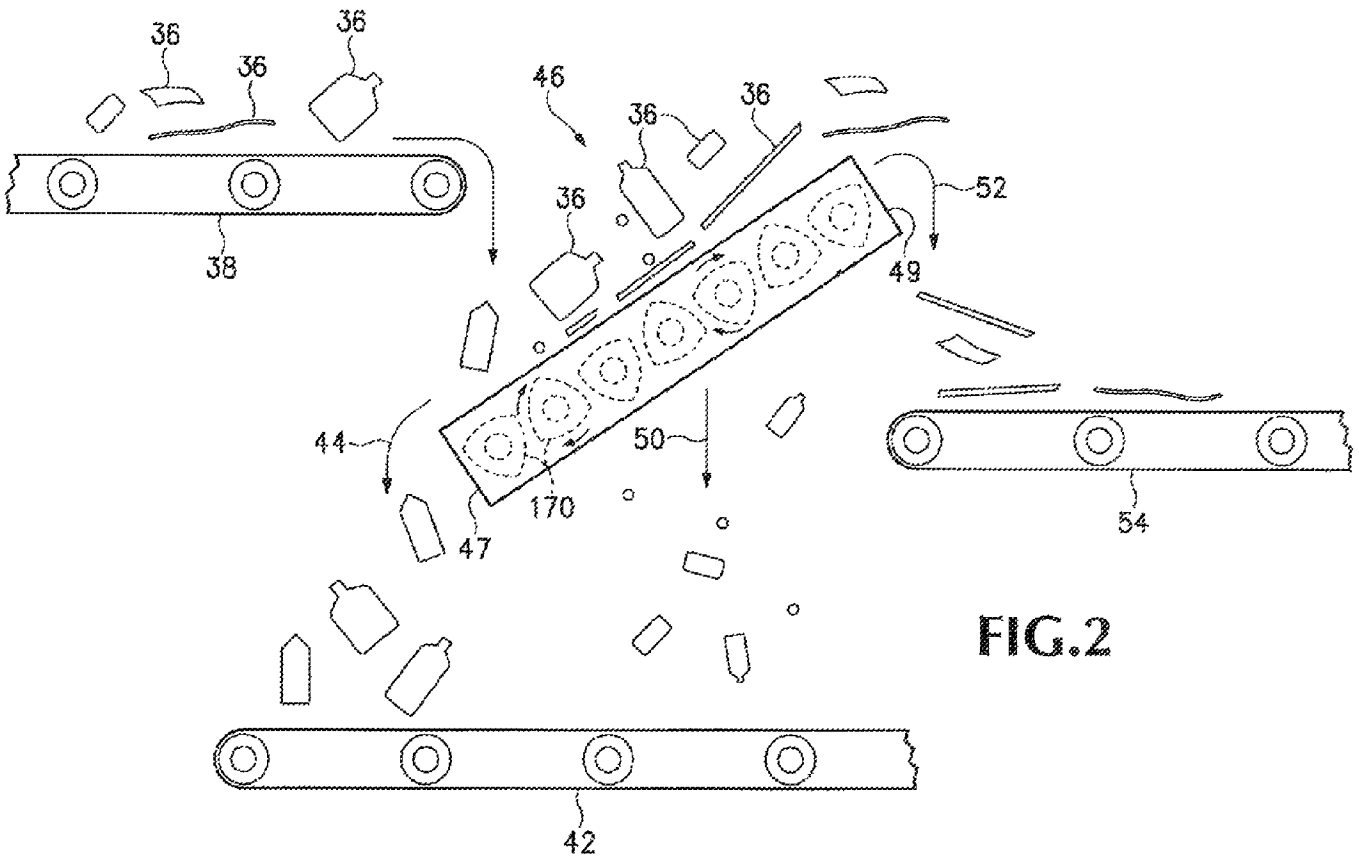
FIG. 2 is a side schematic view of a separation screen used for further separating the solid waste recyclable material output from the air separator shown in FIG. 1, according to various embodiments.

FIGS. 1 and 2 depict common components of a modern MRF, to which the embodiments disclosed herein may apply. In the example embodiment shown in FIG. 1, an air separation system 12 separates out the recyclable solid waste materials 36 from other solid waste material 32, based on weight vs surface area. The lightweight materials in this case will contain a high majority of the high value recyclable materials while heavier solid waste falls down the chute and onto the conveyor shown. These lightweight materials are transported, in the depicted embodiment, to a separation screen 46 shown in FIG. 2. In this embodiment, the disc screen is utilized to separate the material by shape; with the light recyclable materials moving up the screen in a vertical direction. However, other types of screens may be used. In other embodiments, another separation screen, trommel, ballistic, or some other type of separation system is used for removing small items from the solid waste prior to the density separation to capture small organic material.

Referring first to FIG. 1, the air separator 12 includes an air chamber 28 that receives solid waste 21 from a conveyor 20. In one embodiment, the solid waste 21 is the waste typically retrieved from residential and office trash containers and bins. For example, the solid waste 21 includes, but is not limited to; food, bottles, paper, cardboard, jars, wrappers, bags, other food containers, or any other items that may be thrown away in a home or office. The waste stream may include a combination of both non-recyclable and recyclable materials.

A fan 22 pulls relatively light recyclable solid waste 36 over the top of a drum 26 into the air chamber 28 and onto a conveyor 34. This is accomplished by taking more air out of the air chamber 28 than is returned by the fan 22. Heavier solid waste 32 falls down chute 33 onto a conveyor 40. In one embodiment, the drum 26 rotates to help carry the lighter recyclable solid waste items 36 over drum 26 and onto conveyor 34. The recyclable solid waste items 36 are carried up through air chamber 28, out opening 37, and dropped onto a conveyor 38.

The light recyclable solid waste materials 36 may include newspaper, junk mail, office paper products, cardboard; plastic bottles, plastic bags, jugs, other plastic containers; and aluminum, tin, or steel cans and other metal containers.

The heavier solid waste material 32 can include rocks, concrete, food waste, wood, or any other type of material that has a relatively heavier weight than the recyclable solid waste materials 36. Alternatively, some of the solid waste material 32 may have weights comparable with the weight of the lighter recyclable solid waste items 36. However, the combination of weight and a relatively small surface area may prevent sufficient air pressure to be produced underneath some of the materials 32, preventing these materials from being blown into air chamber 28. These items also fall down through chute 33 onto conveyor 40.

Figure 3:
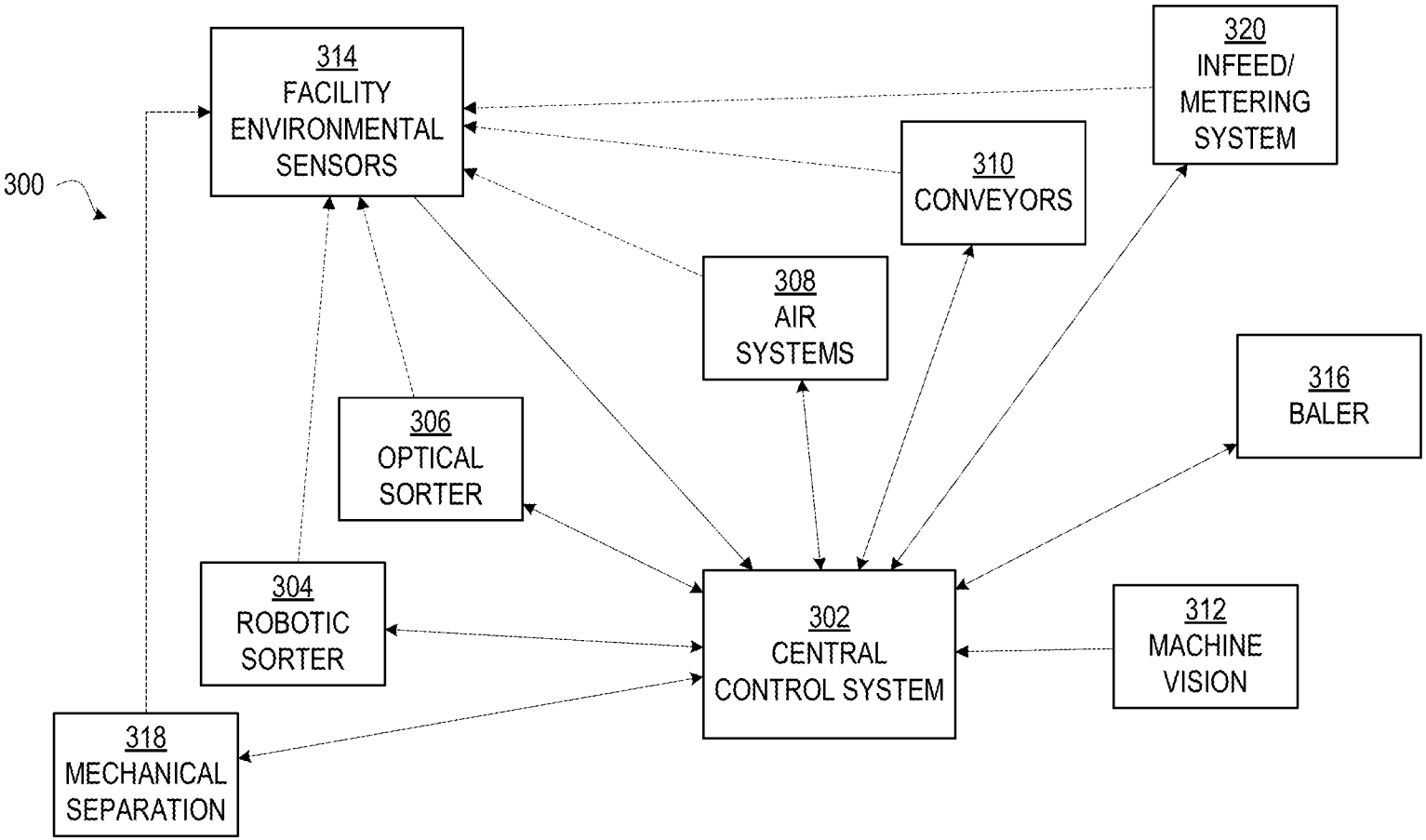
FIG. 3 is a block diagram of a system for autonomous data collection and system control for a MRF, including a MRF implementing the separators of FIGS. 1 and 2, according to various embodiments.

There may be some recyclable items in heavy solid waste 32. However, the majority of the recyclable solid waste items 36 referred to above that include paper and cardboard fiber materials, plastic films, and relatively light plastic and metal containers are typically blown over drum 26 and carried by conveyor 34 through air chamber 28 and out the opening 37. Recyclable items in heavy solid waste 32 may be subsequently removed from non-recyclable items using various other sorting mechanisms, such as one or more robotic sorters 304 (FIG. 3), one or more optical sorters 306 (FIG. 3), and/or one or more additional air systems 308 (FIG. 3). In some embodiments, conveyor 40 may carry heavy solid waste 32 to these additional sorters. In other embodiments, these additional sorters may be disposed at the end or outfall of chute 33.

The air flow inside of chamber 28 promotes the movement and circulation of the lighter recyclable solid waste items 36 over the top of drum 26 and out of the opening 37. The fan 22 can be connected to air vents 30 located on the top of chamber 28 in a substantially closed system arrangement. The fan 22 draws the air in air chamber 28 back out through air vents 30 and then re-circulates the air back into air chamber 28. A percentage of the air flow from fan 22 is diverted to an air filter (not shown). This recycling air arrangement reduces the air-pressure in air chamber 28, further promoting the circulation of light recyclable solid waste materials 36 over drum 26 and out opening 37.

The negative air arrangement of the air recirculation system can also confine dust and other smaller particulates within the air chamber 28 and air vents 30. A filter (not shown) can further be inserted at the discharge of fan 22 such that a percentage of the air from the fan is diverted to a filter (not shown) to further remove some of the dust generated during the recycling process.

Current air separation systems only separate non-recyclable materials used for shredding and burning from other heavier materials. For example, air separation systems have been used for separating wood from other non-burnable materials such as concrete, rocks, and metal. solid waste recyclable materials are already separated out prior to being fed into air separation systems. However, as will be discussed below, Referring to FIG. 2, the light recyclable solid waste items 36 are carried along conveyor 38 and dropped onto a separation screen 46. In one embodiment, the separation screen 46 includes dual-diameter discs 170 arranged to form particular openings between adjacent disc rows. The discs 170 have arched shapes that when rotated both move the items 36 up the screen 46 while at the same time vibrating the light items 36 up and down in a vertical direction. However, other types of separation screens can also be used. The selection of a particular type or types of separation screen(s) will depend upon the specifics of a given embodiment.

In some applications, disc or vibratory screens are used for classifying what is normally considered debris or residual materials versus recoverable commodities; in these applications, the disc screens can classify material in two distinct ways: 1) sizing—the screen creates overs and unders sizes, for example, from ¼ inch up to 12 inch; and 2) physical characteristics—the screen can separate 2D from 3D objects like old corrugated cardboard (OCC), and other fiber materials can be removed from plastic and metal containers.

The combination of gravity, the upwardly inclined angle of separation screen 46, and the shape, arrangement and rotation of discs 170, cause some of the light recyclable solid waste items 44 to fall back down over a bottom end 47 of separation screen 46 onto a conveyor 42. Typically, these solid waste recyclable items 44 include containers such as milk jugs, plastic bottles, beer cans, soda cans, or any other type of container having a shape and large enough size to roll backwards off the bottom end 47 of screen 46.

Other recyclable solid waste items 50 drop through interfacial openings (IFOs) formed between the discs 170 while being carried up separation screen 46. The items 50 falling through the openings in separation screen 46 also fall onto conveyor 42 and typically also include plastic and metal containers. For example, the items 50 may be smaller volume containers. In one embodiment, the opening is 2"×2" but can be larger or smaller depending on the screen design. In another embodiment, where separation screen 46 is configured at 2 inches, the IFO is 1.25"×2.25". It will be understood that varying the IFO size may also impact the size and type of items 50 that pass through separation screen 46.

The remaining recyclable solid waste items 52 are carried over a top end 49 of separation screen 46 and dropped onto a conveyor 54. The recyclable solid waste items 52 often include items with relatively flat and wide surface areas such as plastic bags, plastic films, paper, cardboard, flattened containers, and other types of fiber materials. These waste materials may include other types of fiber materials and plastic film material. These relatively flat recyclable solid waste items have less tendency to topple backwards over the bottom end 47 of separation screen 46 and, further, have a wide enough surface area to travel over the openings between discs 170.

Thus, the combination of the air separator 12 in FIG. 1 and the screen separator 46 in FIG. 2 first separate relatively light recyclable solid waste items 36 from other solid waste material 32 (FIG. 1) and then further separate the recyclable solid waste plastic and metal containers 44 and 50 from the recyclable solid waste plastic, paper and cardboard fiber material 52 (FIG. 2). With particular respect to FIG. 2 and screen separator 46, 3D objects, e.g. cartons, containers, etc., typically will be sorted out, leaving only 2D objects, e.g. paper, foil, films, as described above, coming from screen separator 46 and onto conveyor 54. This process will be described in greater detail herein.

Referring briefly back to FIG. 1, in some embodiments another separation screen 14, trommel, or some other type of separation system is used for removing small items from the solid waste 21. In one embodiment, the screen 14 includes discs 16 arranged to form openings of the same or various sizes that allow smaller materials 18, alternatively referred to as "fines", to drop through the screen 14. These smaller materials 18 can include small rocks, dirt, etc., that might otherwise be blown against different parts of the air separator 12, possibly damaging, or at the least, increasing the wear and tear on the air separator 12. In some embodiments, the configuration of screen 14 is similar in nature to screen separator 46 depicted in FIG. 2, with a plurality of discs that form IFOs, through which the smaller materials 18 fall. However, the IFO size, in such embodiments, may vary with respect to the types of materials being separated, viz. "fines" may require a considerably smaller IFO compared to screen separator 46 to allow substantially all solid waste 21 to pass, for later separation as described above with respect to FIGS. 1 and 2.

It should be understood that the configuration depicted in FIGS. 1 and 2 are examples only. The number and configuration of components of an MRF will depend upon a variety of factors, such as available physical space, materials to be handled, sorting methods employed, and intended output product, to name a few possible factors. Further, some possible components not depicted in FIGS. 1 and 2 may be present, that will be discussed below with respect to FIG. 3.

As mentioned above, once the initial screens remove the fines 18 and heavy contaminants, and separate the recyclables into 2D and 3D objects, in embodiments the commodities will be separated further, and additional contaminants removed. The 3D objects typically contain a majority of the plastic bottles, tin and aluminum food and beverage containers. However, many other items in the stream can adopt a 3D shape. For example, 3D objects can include a small plastic bag filled with shredded paper, bunched up textiles, or a cardboard box. These type of objects may be transported into the 3D object stream. While human sorters can be used to remove the objects prior to the container separation, automation can take the place of this operation in various embodiments, as will be discussed below. For example, by utilizing a control system that employs one or more of neural networks, vision cameras and optical sensor arrays, 3D contaminants can be removed without human intervention.

The 2D objects can require additional attention and/or equipment due to the nature of the contaminants. For example, the focus of the additional equipment would be to remove the contamination and refine the paper fiber. The primary sources of contamination are brown OCC, fiber board, plastic film, flattened containers and wet paper (including diapers, napkins and tissue paper). Depending on the level of contaminants, they can first be separated by size, e.g. by removing or otherwise separating materials that are smaller than 4 inches in any two dimensions. Other embodiments may separate out materials of different dimensions, depending upon a given implementation and specifications for a desired output product. If necessary, in some embodiments a second mechanical sort can employ near infrared light to optically sort the material to purify the fiber. This can be done by removing the paper to create a clean stream or removing the plastic contaminant. These components can be changed on demand or removed from the system design depending on the type and volume of contaminant. This material can be handled in several embodiments, including but not limited to conveyor transfer or pneumatic transfer.

Regardless of whether the level of contaminant requires mechanical or optical sorters, in some embodiments human sorters may still be employed to inspect the resulting stream, to further refine the materials by removing any browns or missed plastic materials. In other embodiments, automation can take the place of this operation. By utilizing neural networks, vision cameras and optical sorters (each of which will be described below), the cardboard prohibitives or out-throws or plastic contaminants in such embodiments can be removed without human intervention.

FIG. 3 depicts an example system 300 for autonomous data collection and system control for a MRF. In embodiments, system 300 includes a central control system or unit 302, which receives data inputs from a variety of sources and may further use these inputs to control various systems of the MRF. These various sources, as will be discussed further below, can include one or more material handling units, which can include units such as mechanical separators or sorters, robotic sorters, optical sorters, air systems/sorters, conveyors, balers, infeed/metering systems, as well as any other general or specialized material handling units that may be employed by a MRF, as appropriate to a particular solid waste stream for which the MRF is configured to handle. The components depicted in example system 300 are not intended to be comprehensive, but rather exemplary; central control system 302 may receive input from any and all components of an MRF as part of implementing autonomous control of the MRF.

Central control system 302 may be implemented using one or more computer devices 500, as will be described below with respect to FIG. 7, by software that runs on a computer device 500, as will be described below with respect to FIG. 8, or as a combination of hardware and software. Central control system 302 may be implemented local to the MRF (e.g. on or near the MRF premises), in a remote location, or a combination of the two. Central control system 302 may execute on one or more computer devices 500 that are under the control of the MRF owner/operator, and/or one or more computer devices 500 that are under the control of a third party, e.g. a cloud service provider or remote service provider. In some embodiments, central control system 302 may be implemented in whole or in part by software that executes on a remote service provider, such as a cloud and/or compute provider, which may communicate with a front end or client under the control of the MRF operator. In some embodiments, central control system 302 may include one or more interface modules or units that collect information from various equipment and environmental sensors 314 of the MRF, and provide the information to a remote service provider, and likewise may receive instructions from the remote service provider to carry out the functions of central control system 302.

In some embodiments, central control system 302 may include, in whole or in part, custom or purpose-built hardware, such as one or more application-specific integrated circuits (ASICs), field-programmable gate arrays (FPGAs), discrete circuits, other electronic and/or software implements suitable to a given implementation, or a combination of any of the foregoing. In some embodiments, one or more components of central control system 302 may implement artificial intelligence (AI), such as a neural network or another suitable AI implementation, as may be known in the prior art. In embodiments, the central control system 302 implements the methods disclosed herein using software, hardware, or some combination of the foregoing. Further examples of hardware and software implementations are provided herein with respect to FIGS. 7 and 8. Central control system 302, in embodiments, is a type of Supervisory Control And Data Acquisition (SCADA) system.

Central control system 302 can receive various data streams, which control system 302 utilizes to adjust various systems of the MRF, in embodiments. In some embodiments, the various data streams feed into the AI system or portion of control system 302. Depending on the particulars of a given AI implementation, example data streams may be used to train AI neural net. In other implementations, the AI neural net may self-train or learn on-the-fly using real-time data collected from the various data streams. The data streams may come from one or more sensors, cameras or instruments, as will be discussed below.

Data streams may be obtained from various sources within the MRF, such as one or more robotic sorters 304, one or more optical sorters 306, one or more air systems 308, one or more conveyors 310, one or more machine vision units 312, and/or one or more facility environmental sensors 314. These various sources may further be in communication with one or more other sources, as will be discussed below; these communications may be direct, or logical, with central control system 302 acting as an intermediary. As will become apparent from the following discussion, a degree of overlap may exist between the different sources, e.g. machine vision may be utilized in conjunction with one or more of the sorters, etc.

Robotic sorters 304 may include any form of robotic sorting such as, but not limited to, a six axis robot, Selective Compliance Assembly Robot Arm (SCARA) Robot, parallel robot, delta robot, or another type of robot suitable to handle an intended waste stream. In some embodiments, robotic sorter 304 may be in two-way communication with central control system 302, as may be seen in FIG. 3. For example, a robotic sorter 304 may report the number and type of picks in different streams within the MRF to central control system 302, which can use this information to coordinate activities at other plant locations, track the operating status and time of the robotic sorter 304 to determine whether maintenance should be scheduled, and otherwise assess the current status of the waste stream that is passing by the robotic sorter 304. Central control system 302 further may instruct robotic sorter 304 to activate or deactivate, depending upon feedback and data from other sensors on other systems within the MRF. Central control system 302 may also be able to reconfigure robotic sorter 304 to sort out different materials or materials of varying shapes or sizes, depending upon the nature of the waste stream presented to robotic sorter 304.

Optical sorters 306 may include any implementation where optical recognition techniques are used on a waste stream to detect the presence of undesirable objects or contaminants in a waste stream. In some embodiments, an optical sorter 306 may employ a suitable light source or X-Ray radiation to aid in recognition of contaminants. For example, in optical implementations where desirable materials reflect or absorb various infrared wavelengths differently from contaminants, optical sorter 306 may use an infrared light source in conjunction with an infrared sensitive camera or optical detector to distinguish undesirable contaminants from desirable recyclable material. Different light sources (possibly with different wavelengths) and/or cameras or other visual sensors may be employed where different types of contaminants are to be detected, with the choice of light and sensor made with respect to the needs of a particular implementation. The recognized contaminants may then be mechanically removed at the direction of optical sorter 306, such as by mechanically grabbing (such as with a robotic sorter 304) or ejecting the contents, or via air separation, where precise blasts of air can be used to eject contaminants. Other means for removing or expelling contaminants detected by optical sorter 306 may be used, depending upon the specific needs of a given embodiment.

As seen in the example embodiment of FIG. 3, optical sorter 306 is in communication with central control system 302, where optical sorter 306 can transmit its detecting and ejecting of various contaminants to control system 302, to record the data used by optical sorter 306 for its identification. As with the data stream from robotic sorter 304, control system 302 may use the data stream from optical sorter 306 to determine the status and quality of the waste stream moving past optical sorter 306, and take any such actions as control system 302 determines are necessary to ensure optimal operation of the MRF. For example, data from optical sorter 306 may be passed downstream to a robotic sorter 304 by central control system 302, which central control system 302 may be able to reconfigure dynamically based upon optical sorter 306 information. Likewise, optical sorter 306 may be in two-way communication with central control system 302, and so may receive data from control system 302. For example, optical sorter 306 may be capable of being activated, deactivated, or otherwise reconfigured by central control system 302 to monitor for and remove different types of contaminants (within the limits of optical sorter 306 hardware).

Air system 308 may include an air jet sorter or remover, which uses precise air jets to eject contaminants from a waste stream. Alternatively or additionally, air system 308 may include air separator 12, which acts in conjunction with structures such as one or more conveyors and/or drums, as discussed above with respect to FIG. 1, to provide rapid, relatively rough, sorting of recyclable materials from non-recyclable materials on the basis of weight and size. In embodiments where air system 308 is implemented as a more precise air jet sorter, air system 308 may be triggered by a machine vision system or sensor, such as optical sorter 306, which can supply air system 308 with locations for air jets to remove identified contaminants. In other embodiments, other sensors may be in communication with air system 308, e.g. inductive, optical, weight, density etc., as needed to identify contaminants for removal from a waste stream. These other sensors may be part of one or more of the other data stream sources discussed above. In still other embodiments, multiple data sources may feed air system 308.

Air system 308 may also more generally act as an air source to other sorters, e.g. robotic sorter 304, which may be pneumatically operated. In some embodiments, air system 308 may be in two-way communication with central control system 302. Air system 308 may report its status to control system 302, such as available air flow, pressure, number of objects removed or sorted over a given time period, accuracy (whether a given object was successfully removed or sorted, etc.). As with other data streams, central control system 302 may use feedback from air system 308 to dynamically adjust the operation of various systems of the MRF. Likewise, central control system 302 may instruct air system 308 to activate or deactivate, or adjust operating parameters, e.g. increase or decrease air pressure, on the basis of information obtained from various data streams. For example, where central control system 302 determines that lighter contaminants may pass by air system 308, central control system 302 may signal air system 308 to decrease its working air pressure, to be sure that lighter contaminants are successfully removed from the waste stream. The air system 308 can contain temperature, flow and speed instrumentation to report its readings digitally to central control system 302.

Conveyors 310, which may include conveyors 20, 34, 38, 40, 42, and 54 as depicted in FIGS. 1 and 2, are generally used to conduct waste streams between various sorting mechanisms, e.g. air system 308, screen 46, etc. Each conveyor 310 may have positioned at an end or along its length a sorting mechanism, which can include a robotic sorter 304, optical sorter 306, and/or air system 308. Multiple conveyors 310 can be equipped with scales using load cells, speed sensors or photo eyes that report the mass flow of the waste material at different parts of the system. In some embodiments, weight measured by a load cell or other weight measuring mechanism can be used to detect and remove contaminants that exceed expected weight or density, either by a sorter (as described above) or at the direction of central control system 302.

As shown in the example embodiment of FIG. 3, one or more conveyors 310 may be in two-way communication with central control system 302. Information captured by a conveyor 310, such as weight, speed, mass flow, or any other measured metric, may be provided to central control system 302 to help it carry out management of the MRF. Similarly, central control system 302 may adjust operating parameters of a conveyor 310, including activation/deactivation, speed, direction (where conveyor 310 is configured to alter the direction of the waste stream, and whether maintenance is needed. Any other parameters may be monitored and/or controlled for each conveyor 310, as needed by the specifics of a given embodiment.

As seen in FIGS. 1 and 2, a MRF may include mechanical separation 318. For example, a MRF may be equipped with vibratory equipment, to form a vibratory screen. For another example, a MRF may include a screen separator, such as separation screen 46 of FIG. 2 that may employ discs, or a ballistic separator. Such mechanical separation 318 may be used as an initial separation means for a given waste stream to generate a relatively crude recoverable material stream and residual stream. Each such stream may then be passed through one or more other sorters (e.g. robotic, optical, air, vibratory, as discussed above) for further purification of the recoverable material stream, and further recovery of recoverable materials from the residual stream. It is understood that each of these sorting means is, in various aspects, mechanical in nature; thus, mechanical separation 318 connotes any sort of separation technology useable with a MRF that is not otherwise discussed herein. Such mechanical separation 318 may include sensors feeding a data stream to central control system 302 indicating the efficiency of the separation, to allow central control system 302 to engage the additional sorter(s) as necessary. Other sensors, as discussed elsewhere, may feed central control system 302 a data stream about the operating status of the mechanical separator, e.g. whether the separator is jammed or clogged, is in need of service, requires a speed adjustment to optimize efficiency, etc.

The various sorters (robotic, optical, air, and/or any other type) may be located at any appropriate location within the MRF. In some embodiments, sorters of different appropriate types may be located at a variety of locations throughout the MRF, with each sorter in communication with central control system 302. Central control system 302, in turn, may use the various data streams to selectively activate or deactivate sorters, potentially dynamically or in real time while the MRF is actively sorting waste streams, depending upon the changing nature of the waste stream or streams. For example, by using machine vision, central control system 302 may determine that a given type of sorter at a particular location should be activated or deactivated. Similarly, using machine vision and/or feedback from data streams provided by one or more sorters, as described above, central control system 302 may alter the operating parameters of one or more sorters, conveyors, and/or any other controlled system of an MRF to optimize MRF operation.

The results of the various sorters, in various embodiments, is essentially two (or more) streams of waste: at least one stream comprised primarily of purified recyclable goods, and a residual stream of materials remaining following separation of the recyclable goods. The sorters may accomplish this in a negative or positive fashion. In negative sorting, a given sorter removes identified contaminants from a mixed stream, with the stream thus becoming purified. In positive sorting, a given sorter removes the target materials that form the purified stream from the mixed stream, with the resultant or default stream moving on for further processing by the system or in some embodiments forming the residual stream. In either example, the removed materials (whether contaminants or desired materials) form a second stream, which can be diverted for further processing. Whether a negative or positive sorting strategy is employed can depend upon the specifics of a given implementation, such as the configuration of the MRF facility. Still further, some embodiments may employ a mix of negative and positive sorting with different sorters at different locations within an MRF.

Central control system 302, in some embodiments, may be able to change a given sorter (whether robotic, optical, air, or another suitable sorting technology) between a positive and negative sorting strategy in response to feedback from various data streams to optimize sorting efficiency. In some embodiments, a combination of strategies may be employed, with a positive sorting strategy being initially employed to create a new stream of desirable materials, e.g. enhancing, optimizing or maximizing recovery (e.g. quantity) of desirable materials, and a second sort with a negative sorting strategy being employed on the new stream as a quality control step to ensure stream purity. The results of the negative sort may be redirected back to another suitable stream based upon the nature of the contaminant, e.g. to another recyclable stream, or to a stream for disposal.

In some embodiments, contaminants rejected or sorted by the various sorters described above from a given waste stream may be routed or diverted, such as by a conveyor 310, to another waste stream for further processing. It should be understood that the residual or waste nature of the stream is relative; the remaining materials may themselves be recyclable or otherwise desirable, but of a different nature than the purified stream materials. The residual stream may thus be subject to further sorting to obtain an additional purified stream of different recyclable materials and another residual stream. The process of sorting/purification may be repeated on the stream until all materials of value have been extracted, leaving only materials intended for disposal.

In some embodiments, one or more of the sorters, such as robotic sorter 302, may be configured to manipulate objects such as recyclable material that is in a 3D configuration. For example, waste paper may be collected into a bag or stack, which presents as a relatively dense 3D object. A robotic sorter 302 (or similar robotic manipulator) may be configured to open or otherwise take apart the bag or stack, and reduce it to a collection of 2D objects, e.g. paper or cardboard sheets. Such materials may be returned back through the MRF at an appropriate point for resorting based on their 2D characteristics.

Central control system 302, in the example embodiment of FIG. 3, receives input from a machine vision unit 312, which it can then use to assist in efficient management of the MRF. Camera and vision systems, such as a machine vision unit 312, can be configured to report composition and contaminant levels of different streams, as described above. A machine vision unit 312 may be in data communication with one or more of the sorters, e.g. robotic sorter 304, optical sorter 306, air system 308, either directly or by way of input to central control system 302 (depicted in FIG. 3), to provide guidance for one or more sorters for removing contaminants. Machine vision unit 312 may utilize any suitable machine vision technique now known or later developed appropriate to a given implementation, e.g. object recognition, pattern matching, edge detection, etc.

In embodiments, machine vision unit 312, potentially in conjunction with central control system 302, may distinguish between 2D and 3D objects for direction (such as via a conveyor 310) to an appropriate sorting unit. For example, a milk carton, bottle, can, etc., may be recognized as 3D, compared to a 2D material such as paper, OCC, foil, plastic sheeting, etc. With this feedback, central control system 302 and/or a sorting unit such as robotic sorter 304 or optical sorter 306 (which may be in direct communication with machine vision unit 312) may expel or otherwise redirect 2D from 3D objects so that each is appropriately processed and handled.

System 300 may also include mechanisms located at both the input and output of a MRF. On the output side, a MRF may be equipped with one or more balers 316, designed to bundle, bale, or otherwise package materials from a recoverable material stream, for subsequent shipment to a receiving facility. A baler 316 may also be used to package a residual stream, for transport to a landfill or other suitable disposal facility, depending upon a given MRF implementation. Central control system 302 may receive information from a baler 316, such as operating status (e.g. whether normal, in need of servicing, jammed, etc.), amount of material processed, capacity, etc. These inputs may come from one or more environmental sensors 314, discussed below, and as depicted via the dashed line in FIG. 3. Central control system 302, in embodiments, is configured to control a baler 316, to command it to start or stop, adjust baling or packaging size, etc.

On the input side, a MRF may be equipped with one or more infeed or metering systems 320. Such equipment may be configured to receive an incoming solid waste stream from an appropriate source, e.g. conveyor from a pile, a shredder, hopper, unbaler, or another solid waste source, and direct the solid waste stream to the start of the sorting pipeline, e.g. screen 14 depicted in FIG. 1. In embodiments, infeed or metering system 320 supplies the central control system 302 with a data stream which can include parameters such as operating status, amount of solid waste being accepted, speed of infeed, nature of the infeed solid waste stream, and other such parameters relevant to the operation of the MRF. These inputs may come from one or more environmental sensors 314, discussed below, and as depicted via the dashed line in FIG. 3. Central control system 302, in embodiments, is configured to control the infeed 320, such as commanding it to start or stop, accept a solid waste stream from one of several possible sources, slow or accelerate the rate of infeed, combine infeed from several sources, or any other control aspect to help optimize the operation of the MRF.

In the example embodiment of FIG. 3, one or more facility environmental sensors 314 may be in communication with central control system 302, to enable central control system 302 to effectively manage the various systems of an MRF. As can be seen in FIG. 3, the facility environmental sensors 314 may include sensors associated with one or more other components of system 300, including robotic sorter 304, optical sorter 306, air systems 308, and conveyors 310. These sensors can enable central control system 302 to monitor the status of the various other components to ensure proper operation, monitoring service intervals, and determination/alerting when a malfunction or other anomaly is detected.

Examples of facility environmental sensors 314 may include bailer control systems (not depicted) that can report number, weight and type of bales or waste material (recyclable or otherwise) produced, moisture sensing instrumentation (to determine if materials are wet and so need to be discarded or rerouted for additional processing), inclinometers on screens, sorters, feeders and conveyors, induction sensing arrays (which may help detect metal contaminants or types of metal for appropriate recycling), laser measurement devices that report volumetric characteristics of the material stream, smart current sensing meters, for detection of overloads or frequency drives that report running amperage of system equipment, positive and negative pressure transducers to compute system vacuum and pressure required to remove objects in positive and negative sorting applications, flow switches and meters to report total air consumed by optical and robotic sorters, and fire detection and identification sensors and cameras, to name a few. Other sensors may be employed in a given embodiment, depending upon the specific needs of the implementation.

In some particular embodiments, facility environmental sensors 314 may monitor for screen health, such as screen 14 and screen separator 46. Screen health can be impacted by issues such as clogging or jamming of IFOs or the screen discs (depending upon a given configuration of a screen; other screen configurations may employ vibratory methods that do not require discs), by debris, by jams, and/or by wear of the discs or vibratory components, to name a few possible issues. Environmental sensor 314 and/or machine vision 312 data streams may be used by central control system 302 to detect adverse impacts to a given screen.

In one possible example embodiment, by utilizing a light source located under a screen or over the screen, the screen can be scanned by an environmental sensor 314 or machine vision camera 312 to determine the status of the screen, such as whether it is operating at its best efficiency or performance. The light source (or sources) and/or machine vision camera 312 may either be in one or more fixed locations, or be positioned on a moveable assembly to allow flexible scanning of the screen. In embodiments, the environmental sensor 314 and/or camera can include a visible light camera, a Near Infra-Red (NIR) spectrometer, an ultraviolet light camera, another suitable light sensor, or a combination of any of the foregoing. The light source may be coordinated to match the sensors used for machine vision. Central control system 302 may continuously or periodically scan the screens, depending upon the needs and configuration of a given embodiment. Some embodiments may allow continuous monitoring of the screen health while in operation, while others may require periodic shutdown of the screen for scanning, such as where the presence of a material stream would hinder detection of screen condition. In some embodiments, the light source may be located on one side of the screen, with the machine vision 312 sensor on the other, where the obstruction of the light source through an IFO would indicate a possible jam.

If an adverse condition is detected, control system 302 may either dispatch an automated means to clear the condition, such as a robotic manipulator to remove or dislodge a jam, use an air jet, may alter the screen operation to clear the screen, such as reversing the rotation of one or more discs or set of discs, or employ another suitable technique. Alternately or additionally, if the jam cannot be automatically cleared or the adverse condition is not subject to automated correction, control system 302 may notify an operator of the MRF of the adverse condition to dispatch manual correction. For example, detection of excessive screen wear may trigger a maintenance notification to the operator that the screen discs (or another component) needs replacing. In some embodiments, the screen discs or other components may be configured to facilitate wear detection.

Depending on the particular embodiment the health of the screen could relate to: wrapping of materials on the shafts or blockages in the screening openings that would require cleaning by the operational staff; wear of the screening surface that would allow the sizing ability to be compromised, which may require maintenance by the operational staff; excessive material and/or prohibitive objects that could cause jams and or damage to the screening surface; or monitoring the RPM of the screen or disc shafts or operative components through variable frequency drives to optimize material flow and component wear life, to name a few possible conditions. Different environmental sensors 314 may be used to detect various conditions.

In an additional embodiment, materials may be utilized within the screening surface, either within different components or within layers of the same component, which would allow the scanning equipment to determine the health of the screen. For example, the screen discs (where employed) may be configured with multiple layers, including a wearable top layer placed over a second indicator layer. The indicator layer may be configured to be uniquely detectable by a machine vision system 312 or another camera when exposed due to the wear of the top layer, thus indicating that the screen disc needs replacement and/or refurbishing.

Other embodiments can include a multiple component MRF facility that includes a select number of additional mechanical and/or optical sorting technologies (in addition to robotic sorter 304, optical sorter 306, and air systems 308), including but not limited to: fines removal; density separation; 2D/3D separation; optical identification of 2D contaminant; optical removal of 2D contaminant; optical purification of 2D product; automated quality control (QC) sorters on 3D material; automated QC sorters on 2D fiber; automated QC sorters on large heavy material; automated Recovery sorters for recovering commodities from residue; and automated System pre-sorters on system infeed. Other components may be possible on different implementations.

By utilizing a combination of one or more of the data streams listed above, as well as any future type of data collection, the central control system 302 in embodiments can identify and classify individual and composite objects, and adjust the principal sorting logic and components of the system, in real time, in response to increase throughput and efficiency, maximize or optimize the amount of materials that are recovered, the purity of the final products, and to create different types of residual or recovered components for use in specific applications. The data streams can also be used by central control system 302 to load balance between various sorting devices, e.g. by splitting or directing multiple waste streams to different material handling units, and/or retasking a given material handling unit to purify and/or recover varying types of materials. For example, where an incoming waste stream is heavy in one particular type of recoverable material, e.g. 2D fiber and paper-based materials, the one or more of various sorters in the MRF that otherwise would sort different materials may be retasked to sort for 2D fiber materials to handle the preponderance of 2D materials. This may result in multiple streams of 2D fiber materials that can later optionally be rejoined together, such as by controlling one or more conveyors 310 and/or one or more balers 316. Alternatively, infeed/metering system 320 may be controlled to pull from multiple waste stream sources to create an initial solid waste stream that is optimally balanced for a given MRF configuration. Thus, central control system 302 potentially allows a MRF to be configured with one or more processing lines with various material handling units that can be reconfigured, potentially in real time, to handle a variety of different types of solid waste streams with various amounts of different recoverable materials. Such a MRF can accept solid waste streams of fluctuating compositions and dynamically reconfigure the various material handling units in real time to target varying types of materials, to optimize recovery from the varying streams and to balance workload across the material handling units.

Further, as mentioned above, the data streams can be used by central control system 302 to create maintenance records and schedules for various components of the implementing MRF. Still further, central control system 302 can utilize the data stream(s) to create human sorting requirements and locations, where the automated sorters cannot practically or feasibly handle complete sorting of the waste stream.

As mentioned above, central control system 302, in embodiments, employs an AI neural network model or models. Thus can enable central control system 302 to research commodity processes and pricing, such as via an external information source like the Internet, to adjust the system to recover the highest possible value stream. An AI driven autonomous central control system 302 can also analyze historical system outputs as well as real-time sensors to create an interaction with one or more bailer units at the end of the MRF processing for preparing recovered recyclable materials for shipment, allowing the system to utilize the bailer more efficiently.

Central control system 302, in embodiments, further utilizes one or more of the data streams listed above, as well as any future type of data stream that may be available, to manage belt speeds and emergency stop scenarios to protect downstream equipment from prohibitive materials. For example, using machine vision, central control system 302 may identify and divert potentially incendiary devices such as batteries or propane tanks, or other similarly dangerous items, prior to ignition or explosion. Further, in the event a flammable object is not recognized or otherwise caught and diverted by central control system 302 and ignites (including potentially initiating a fire in other flammable materials, such as paper to be recycled), the central control system 302 can be configured to detect and recognize combusting material, and divert the material using automated equipment (such as a conveyor or sorter, as described above) to an area for safe containment. Alternatively or additionally, such materials may be extinguished automatically using a fire suppression system (not shown) that is controlled by or otherwise in communication with central control system 302.

Figure 4:
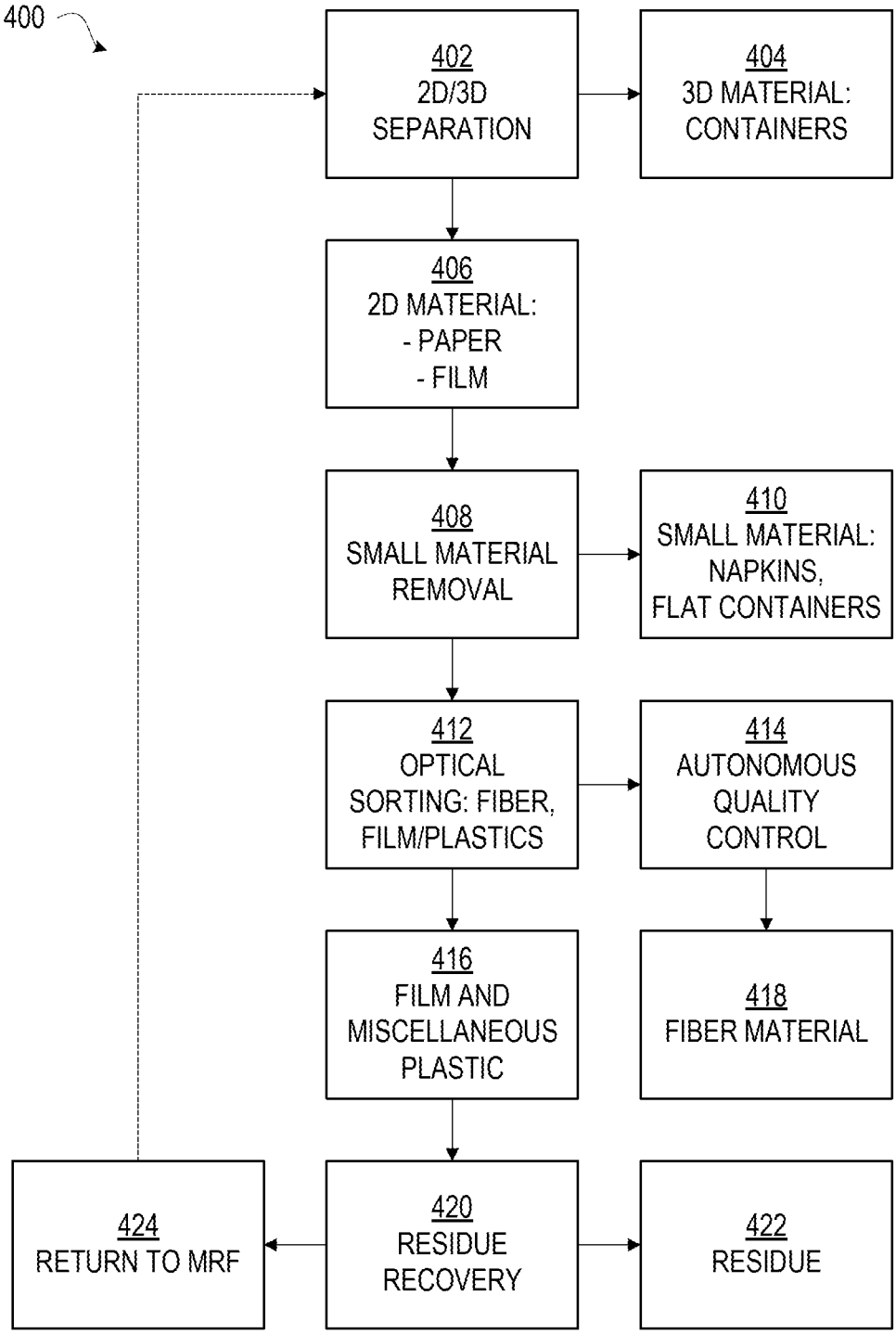
FIG. 4 is a flow chart of a 2D-3D separation process, the resulting sorting to allow the solid waste system to create a clean fiber stream utilizing mechanical, optical and robotic sorting, that may be carried out by the system of FIG. 3, according to various embodiments.

Referring to FIG. 4, the operations for an example method 400 for automated sorting of solid waste, optimizing or maximizing recovery of recyclable or reusable materials, and purification of recyclable/recoverable waste streams is depicted. Method 400 may be carried out by one or more components of system 300, such as central control system 302, in whole or in part. Various operations may be added, omitted, repeated, or carried out in a different sequence depending upon the requirements of a given MRF and implementation. Starting with block 402, 2D materials are separated from 3D materials. This may be initially performed via air separation system 12 and/or screens, such as separation screen 46, as described above with respect to FIGS. 1 and 2. Additional sorting may be refined via separators such as robotic sorter 304, optical sorter 306, and air systems 308, among other possible units.

The result of block 402 may include 3D materials such as containers, e.g. milk cartons, jugs, bottles, cans, etc., shown in block 404, and 2D materials such as paper products and films (plastic, metal, etc.), shown in block 406. The 3D materials may be handled as described below with respect to method 1500 in FIG. 5. The 2D materials may be the result of the sorting procedures from FIGS. 1 and 2, as conveyed by conveyor 54. However, the 2D materials may be further purified by the additional sorting methods described above.

The 2D materials pass on to processing in block 408, where small materials are removed, such as via a screen, described above with respect to FIGS. 1 and 2. Such materials may be sorted out under the direction of central control system 302, by means of a robotic, optical, or air sorter, described above. Small materials may include items such as napkins and flat containers thus form a separated waste stream, in block 410, from the main waste stream.

Following removal of small 2D materials, in block 412 fiber and film/plastics may be separated, such as by using an optical sorter 306. An optical sorter 306 may be able to distinguish between fibers and film/plastics using characteristics such as reflectivity/absorption of certain light wavelengths, such as infrared. As a result of block 412 separation, a separated waste stream of fiber material may be obtained from the main waste stream (e.g., block 418), and a separated waste stream of film and/or miscellaneous plastic material(s) may be obtained from the main waste stream as shown in block 416. Following the optical sort of block 412, the separated stream of fiber material is processed, in block 414 in some embodiments, through a QC station in communication with control system 302, for autonomous quality control, and potential removal of any remaining contaminants not removed in the optical sort. The result, in block 418, is a purified stream of fiber material.

Following removal of small 2D materials and fiber materials, the remaining waste stream may include only film and miscellaneous 2D plastic materials. Such waste stream may be subject to residue recovery in block 420. Block 420 may include further detection and separation of any remaining contaminants and/or waste material that would otherwise reduce the purity of the recyclable waste stream, or otherwise diminish the amount of materials recovered into the recyclable waste stream. Such processing may be carried out by a robotic sorter 304, optical sorter 306, and/or air system 308, or another suitable sorting mechanism, which further may be configured by central control system 302 to locate specific types of contaminants. The result of block 420, in embodiments, is a residue stream of nearly entirely unrecoverable material in block 422, which may be sent to a landfill or other suitable disposal facility, and a stream of potentially recoverable materials in block 424, that may be sent back through the MRF for reprocessing.

Although block 424 shows the stream of potentially recoverable material being placed back into initial 2D/3D separation of block 402, this is only by way of example. Some embodiments may redirect the stream of potentially recoverable material to an intermediate step or station within the MRF. Central control system 302 may determine the optimal location to reintroduce the potentially recoverable stream in the MRF on the basis of real-time input from the environmental sensors 314, and thus control various material handling units in the MRF as appropriate to route the potentially recoverable stream.

Additionally, central control system 302 may determine that a final sort carried out by human workers is necessary to achieve a desired purity level and/or maximize recovery for any of the streams obtained in method 400, and may so direct human workers to carry out a final sort on any given stream. This final human sort may also be applied to waste streams resulting from methods 1500 and 1600 described below.

Figure 5:
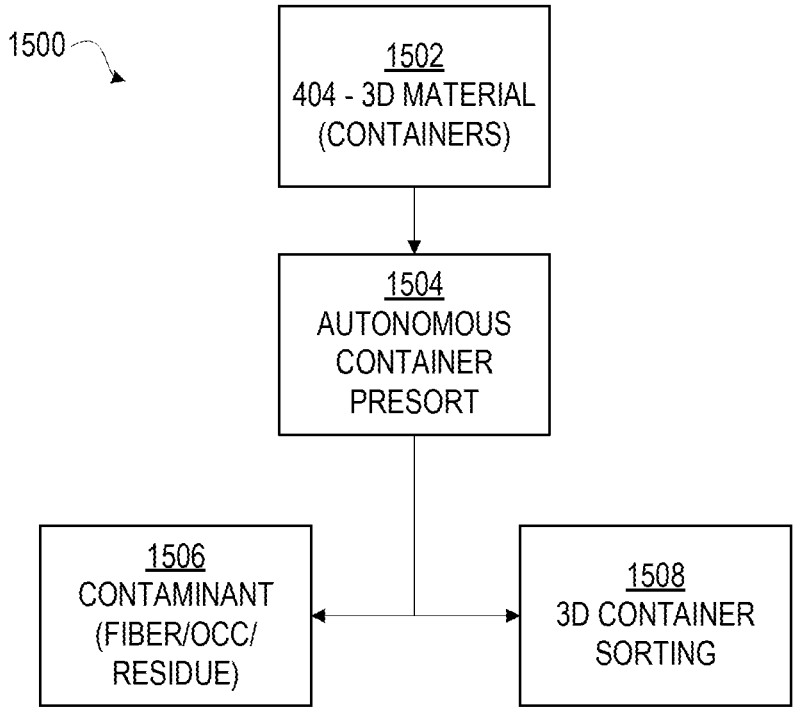
FIG. 5 is a flow chart of a 2D-3D separation to allow the solid waste system to create a clean 3D container stream from the resulting streams of FIGS. 1 and 2, utilizing mechanical and robotic sorting on the container line presort, that may be carried out by the system of FIG. 3, according to various embodiments.

Referring to FIG. 5, the operations for an example method 1500, which may be carried out in whole or in part by one or more components of system 300, are depicted. Various operations may be added, omitted, repeated, or carried out in a different sequence depending upon the requirements of a given MRF and implementation. Starting in block 1502, the 3D materials resulting from block 404 of method 400 are obtained. In block 1504, an autonomous container presort may be carried out, such as by a sorting unit (robotic sorter 304, optical sorter 306, air system 308). This presort can result in a contaminant stream in block 1506, and a high-purity recyclable waste stream of 3D containers, which are subject to further sorting in block 1508.

The contaminant stream of block 1506 may include fiber materials, OCC, and other residues. These residues may have been mis-sorted earlier, and so may be routed back into the MRF at an appropriate stage for further processing and redirection to a recyclable waste stream. Alternatively or additionally, the residues may be too highly contaminated (e.g. saturated with moisture, oil, or another contaminant) to allow for recovery, and so may be combined with other non-recoverable waste streams for eventual shipment to a landfill, to a waste energy facility, or another suitable handling facility.

Figure 6:
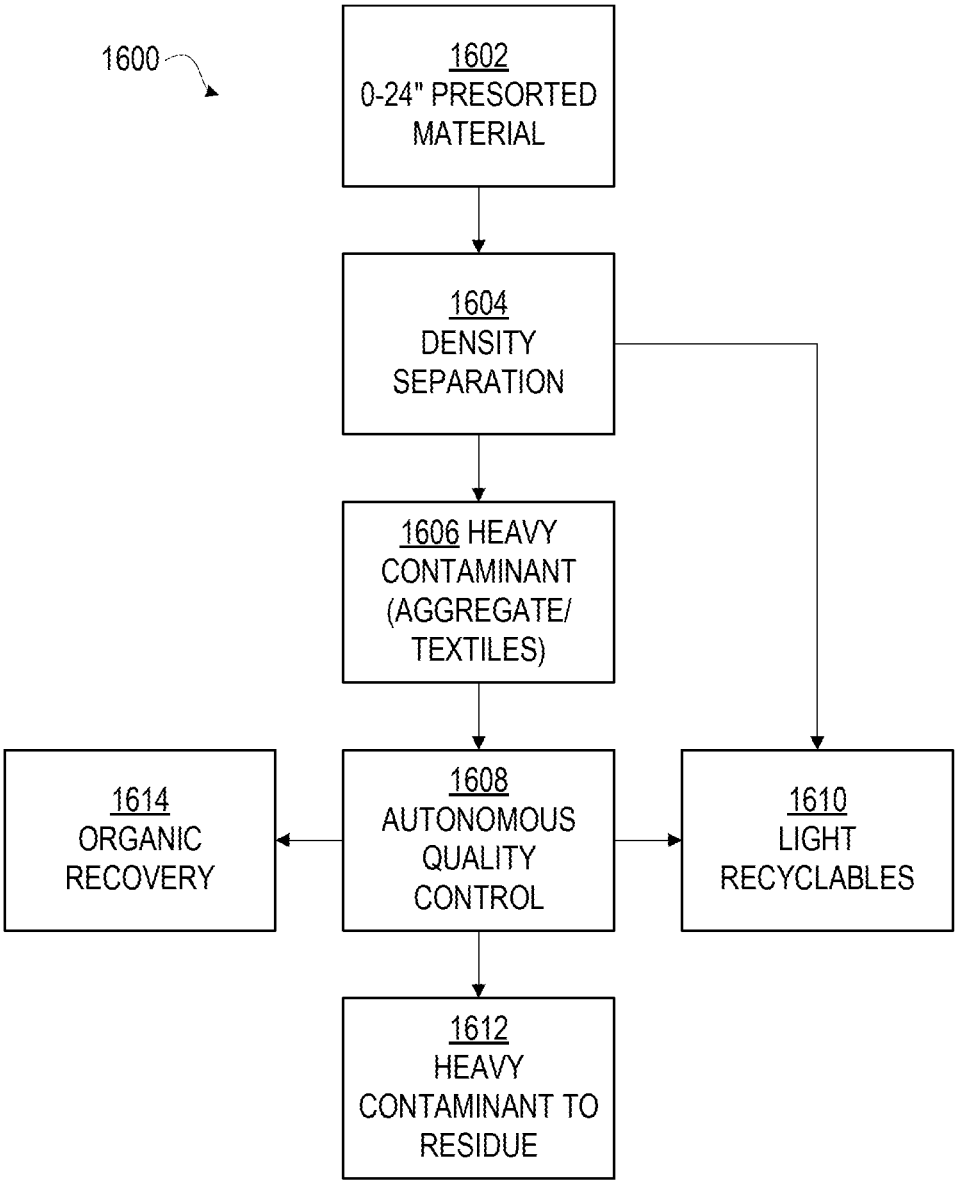
FIG. 6 is a flow chart of heavies residue separation that occurs prior to the 2D-3D separation, to plastics and metals that can be recovered using robotic sorting, that may be carried out at least in part by the system of FIG. 3, according to various embodiments.

Referring to FIG. 6, the operations for an example method 1600, which may be carried out in whole or in part by one or more components of system 300, are depicted. Various operations may be added, omitted, repeated, or carried out in a different sequence depending upon the requirements of a given MRF and implementation. Starting in block 1602, in some embodiments 0-24" presorted material is obtained, such as from block 410 of method 400. Different embodiments may presort for different material sizes. Alternatively or additionally, the operations of method 1600 may be carried out in parallel to the operations of method 400. In block 1604, a density separation is performed on the presorted material. This separation may occur via air separation 12 of FIGS. 1 and 2, where heavier, more dense objects fall from the air stream to conveyor 40. Alternatively or additionally, an air system 308 or load cell in a conveyor 310 may provide sorting via mass and/or density. For example, conveyor 310 may detect higher density (and thus more massive) objects, which central control system 302 can use to redirect the detected materials to an appropriate processing stage in the MRF.

In embodiments, the result of the density separation is a waste stream of heavy contaminants (such as aggregates, textiles, construction debris, and other similarly dense materials), for block 1606. This heavy contaminant stream can be passed through an autonomous quality control in block 1608, where central control system 302 directs sorter units to further extract any possibly recyclable materials.

The result of the autonomous quality control of block 1608, as well as earlier density separation of block 1604, is a waste stream of light recyclables in block 1610, and a waste stream of organic materials in block 1614, which may be subject to organic recovery methods, e.g. packaging, waste energy generation, etc. This waste stream may rejoin the final product of method 400 in block 422, if of sufficient purity, or may be returned to an earlier block of method 400 for reprocessing.

Finally, in block 1612 a heavy contaminant residue remains. This residue may be sent to a landfill, a waste energy generation plant, another suitable disposal facility, or may be returned back to an earlier stage in the MRF for reprocessing as appropriate. In other embodiments, central control system 302 may perform further quality control and/or sorting on the residue, either automatically via a sorting unit or via human processing, to ensure that any recyclable materials that remain are extracted prior to final disposal of the residue.

Embodiments may further include a system for separating lightweight material that is configured to receive a mixture of 2D and 3D recyclable materials, wherein the 2D and 3D objects are separated by shape. These 3D objects are then sorted according to material. The objects removed can include, but are not limited to: paper, cardboard, film plastic and other general residual components. The remaining stream includes the lightweight recyclable containers. The automated system may include any form of robotic sorting such as but not limited to a six axis robot, parallel robot, or delta robot.

Embodiments may further include a multiple component solid waste facility that requires un-processable material to be removed prior to the size, density and shape sorting components. This presort is done using a large automated system to remove these objects by material type or composition. The identification equipment on the system presort would be able to identify metals, compound plastics, large objects, and includes volatile compounds such as batteries, propane tanks and fuel cells.

Figure 7:
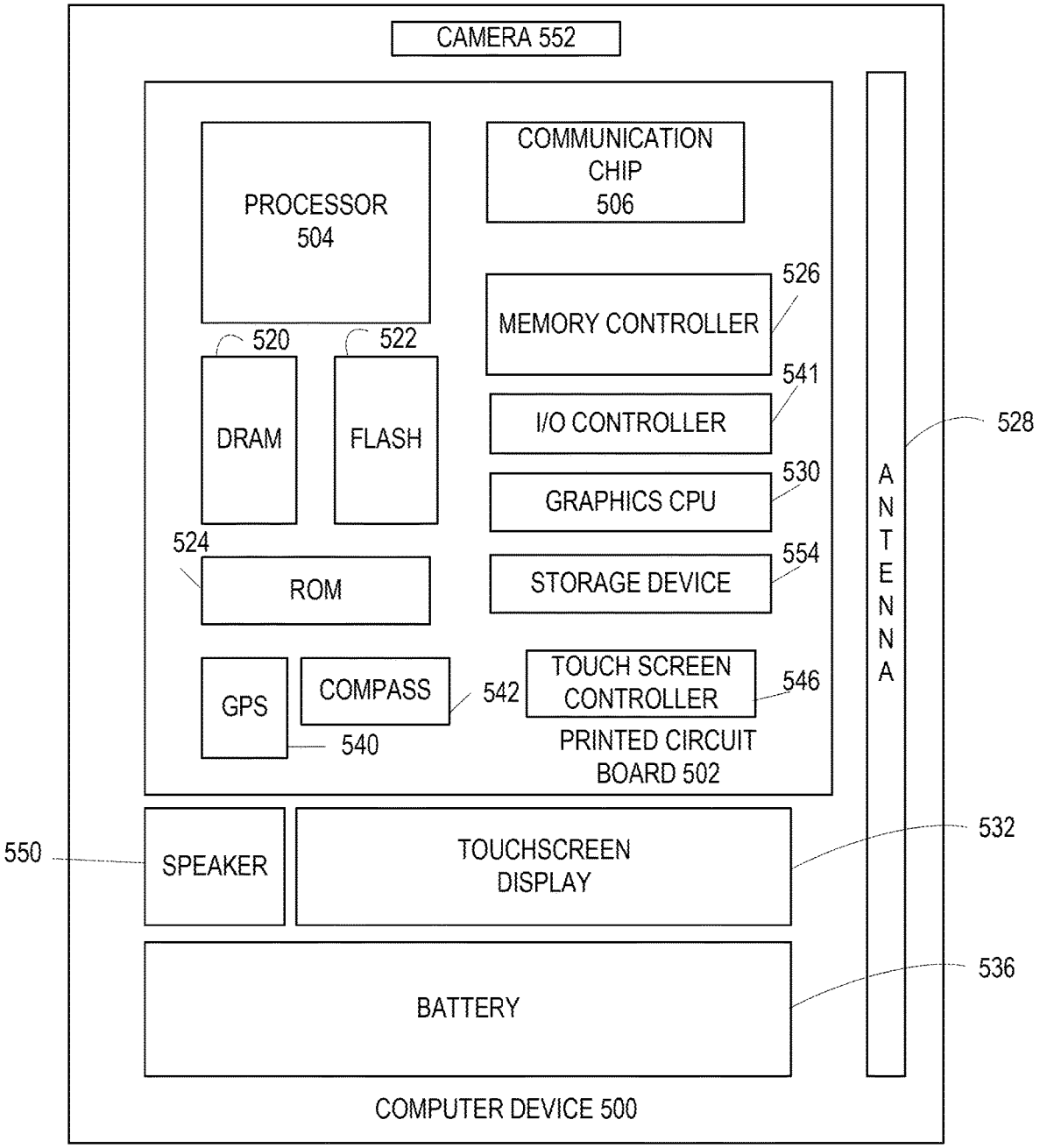
FIG. 7 is a block diagram of an example computer that can be used to implement some or all of the components of the system or methods disclosed herein, according to various embodiments.
Figure 8:
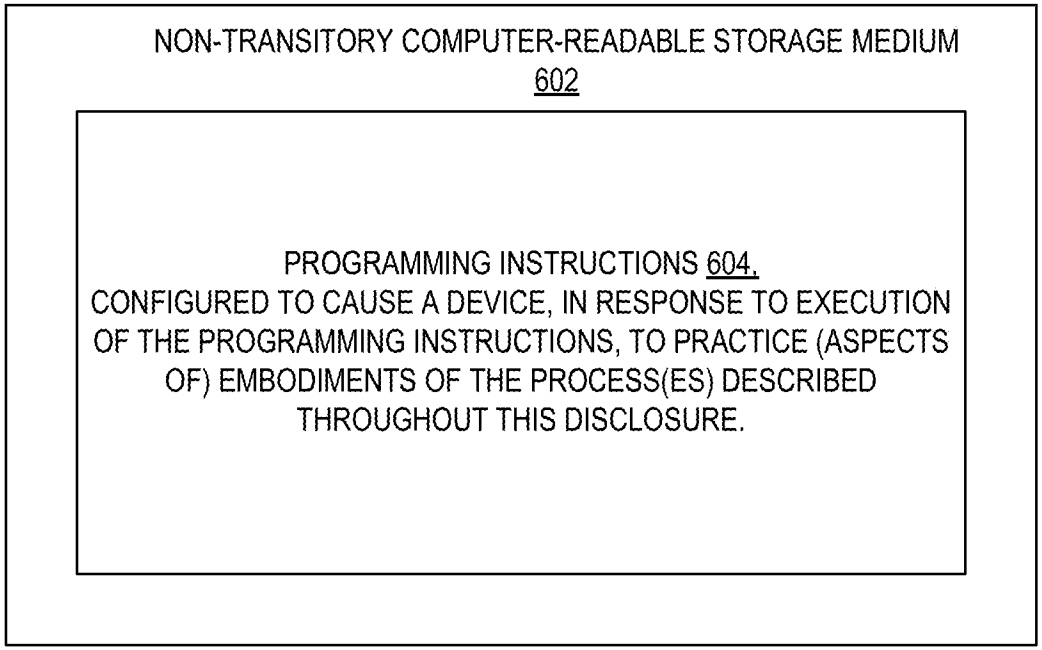
FIG. 8 is a block diagram of a computer-readable storage medium that can be used to implement some of the components of the system or methods disclosed herein, according to various embodiments.

FIG. 7 illustrates an example computer device 500 that may be employed by the apparatuses and/or methods described herein, in accordance with various embodiments. As shown, computer device 500 may include a number of components, such as one or more processor(s) 504 (one shown) and at least one communication chip 506. In various embodiments, the one or more processor(s) 504 each may include one or more processor cores. In various embodiments, the one or more processor(s) 504 may include hardware accelerators to complement the one or more processor cores. In various embodiments, the at least one communication chip 506 may be physically and electrically coupled to the one or more processor(s) 504. In further implementations, the communication chip 506 may be part of the one or more processor(s) 504. In various embodiments, computer device 500 may include printed circuit board (PCB) 502. For these embodiments, the one or more processor(s) 504 and communication chip 506 may be disposed thereon. In alternate embodiments, the various components may be coupled without the employment of PCB 502.

Depending on its applications, computer device 500 may include other components that may be physically and electrically coupled to the PCB 502. These other components may include, but are not limited to, memory controller 526, volatile memory (e.g., dynamic random access memory (DRAM) 520), non-volatile memory such as read only memory (ROM) 524, flash memory 522, storage device 554 (e.g., a hard-disk drive (HDD)), an I/O controller 541, a digital signal processor (not shown), a crypto processor (not shown), a graphics processor 530, one or more antennae 528, a display, a touch screen display 532, a touch screen controller 546, a battery 536, an audio codec (not shown), a video codec (not shown), a global positioning system (GPS) device 540, a compass 542, an accelerometer (not shown), a gyroscope (not shown), a speaker 550, a camera 552, and a mass storage device (such as hard disk drive, a solid state drive, compact disk (CD), digital versatile disk (DVD)) (not shown), a depth sensor (not shown), and so forth.

In some embodiments, the one or more processor(s) 504, flash memory 522, and/or storage device 554 may include associated firmware (not shown) storing programming instructions configured to enable computer device 500, in response to execution of the programming instructions by one or more processor(s) 504, to practice all or selected aspects of the system 300 and methods 400, 1500 and 1600, described herein. In various embodiments, these aspects may additionally or alternatively be implemented using hardware separate from the one or more processor(s) 504, flash memory 522, or storage device 554.

The communication chips 506 may enable wired and/or wireless communications for the transfer of data to and from the computer device 500. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 506 may implement any of a number of wireless standards or protocols, including but not limited to IEEE 802.20, Long Term Evolution (LTE), LTE Advanced (LTE-A), General Packet Radio Service (GPRS), Evolution Data Optimized (Ev-DO), Evolved High Speed Packet Access (HSPA+), Evolved High Speed Downlink Packet Access (HSDPA+), Evolved High Speed Uplink Packet Access (HSUPA+), Global System for Mobile Communications (GSM), Enhanced Data rates for GSM Evolution (EDGE), Code Division Multiple Access (CDMA), Time Division Multiple Access (TDMA), Digital Enhanced Cordless Telecommunications (DECT), Worldwide Interoperability for Microwave Access (WiMAX), Bluetooth, derivatives thereof, as well as any other wireless protocols that are designated as 3G, 4G, 5G, and beyond. The computer device 500 may include a plurality of communication chips 506. For instance, a first communication chip 506 may be dedicated to shorter range wireless communications such as Wi-Fi and Bluetooth, and a second communication chip 506 may be dedicated to longer range wireless communications such as GPS, EDGE, GPRS, CDMA, WiMAX, LTE, Ev-DO, and others.

In various implementations, the computer device 500 may be a laptop, a netbook, a notebook, an ultrabook, a smartphone, a computer tablet, a personal digital assistant (PDA), a desktop computer, smart glasses, or a server. In further implementations, the computer device 500 may be any other electronic device that processes data.

As will be appreciated by one skilled in the art, the present disclosure may be embodied as methods or computer program products. Accordingly, the present disclosure, in addition to being embodied in hardware as earlier described, may take the form of an entirely software embodiment (including firmware, resident software, micro-code, etc.) or an embodiment combining software and hardware aspects that may all generally be referred to as a "circuit," "module" or "system." Furthermore, the present disclosure may take the form of a computer program product embodied in any tangible or non-transitory medium of expression having computer-usable program code embodied in the medium. FIG. 8 illustrates an example computer-readable non-transitory storage medium that may be suitable for use to store instructions that cause an apparatus, in response to execution of the instructions by the apparatus, to practice selected aspects of the present disclosure. As shown, non-transitory computer-readable storage medium 602 may include a number of programming instructions 604. Programming instructions 604 may be configured to enable a device, e.g., computer 500, in response to execution of the programming instructions, to implement (aspects of) system 300, method 400, 1500 and/or method 1600. In alternate embodiments, programming instructions 604 may be disposed on multiple computer-readable non-transitory storage media 602 instead. In still other embodiments, programming instructions 604 may be disposed on computer-readable transitory storage media 602, such as, signals.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present disclosure is described with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

It will be appreciated that the configurations disclosed herein are exemplary in nature, and that these specific embodiments are not to be considered in a limiting sense, because numerous variations are possible. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A non-transitory computer readable medium (CRM) comprising instructions that, when executed by central control circuitry for a material recovery facility (MRF), cause the central control circuitry to:

receive data streams from respective environmental sensors of one or more environmental sensors;

process the one or more data streams to determine an MRF status of the MRF, the MRF status being based on a composition of a material waste stream at one or more locations within the MRF and an operating condition of at least one material handling unit (MHU) of a plurality of MHUs disposed throughout the MRF;

identify and classify objects within the material waste stream based on the data streams;

adjust sorting logic of the central control circuitry based on the identified and classified objects and the MRF status, the adjustment of the sorting logic to optimize purity and/or recovery of at least one recyclable material to be extracted from the material waste stream; and control individual MHUs of the plurality of MHUs based on the adjusted sorting logic to purify and/or recover the at least one recyclable material, wherein, to control the individual MHUs, execution of the instructions is to cause the central control circuitry to retask at least one MHU of the plurality of MHUs from recovering at least one material different than the at least one recyclable material to recover the at least one recyclable material from the material waste stream.

2. The CRM of claim 1, wherein execution of the instructions is to further cause the central control circuitry to:

control or otherwise alert a servicing mechanism to service the individual MHUs when the operating condition of the individual MHUs indicates that service is needed; or signal an operator of the MRF to service the individual MHUs when the operating condition of the individual MHUs indicates that service is needed.

3. The CRM of claim 1, wherein execution of the instructions is to further cause the central control circuitry to implement a machine learning or artificial intelligence model to:

perform the identification and classification of objects within the material waste stream based on the data streams; and adjust the sorting logic according to the identified and classified objects to.

4. The CRM of claim 1, wherein:

the plurality of HMUs include at least two different MHUs selected from a group comprising a conveyor, a mechanical sorter, a robotic sorter, an optical sorter, an air sorter, a baler sorter, and an automated quality control (AQC) sorter; and the one or more environmental sensors include one or more of an infrared (IR) light sensor, a near IR (NIR) spectrometer, an ultraviolet (UV) light sensor, an x-ray light sensor, a visible light sensor, a magnetometer, a chemical sensor, an inductive sensor, a load cell, a density sensor, a speed sensor, an inclinometer, a moisture sensor, a laser measurement device, a current sensor, a pressure transducer, and a flow meter.

5. The CRM of claim 4, wherein, to control the individual MHUs, execution of the instructions is to further cause the central control circuitry to control the individual MHUs to extract contaminants from the material waste stream and extract recyclable materials from the material waste stream.

6. The CRM of claim 4, wherein execution of the instructions is to further cause the central control circuitry to control the individual MHUs to direct the material waste stream to different MHUs of the plurality of MHUs to achieve load balancing among the plurality of MHUs.

7. A method for controlling a material recovery facility (MRF), comprising:

receiving data streams from respective sensors of one or more environmental sensors;

processing the data streams to determine a status of the MRF, wherein the status of the MRF includes a composition of a material waste stream at one or more locations within the MRF and an operating condition of one or more material handling unit (MHUs) of a plurality of MHUs disposed at or near the locations;

identifying and classifying objects within the material waste stream based on the processed data streams;

generating reconfiguration instructions based on the identified and classified objects and the MRF status, the reconfiguration instructions to dynamically reconfigure operation of the one or more MHUs to optimize purification and/or recovery of at least one recyclable material to be extracted from the material waste stream and at least instructing the one or more MHUs to recover the at least one recyclable material stream different than a material currently being recovered by the one or more MHUs; and sending the reconfiguration instructions to the one or more MHUs to dynamically reconfigure operation of the one or more MHUs.

8. The method of claim 7, further comprising controlling a servicing unit to service the one or more MHUs when the operating condition of the one or more MHUs indicates that service is needed; or signaling an operator of the MRF to service the at least one material handling unit when the operating condition of the at least one material handling unit indicates that service is needed.

9. The method of claim 8, wherein the plurality of MHUs comprise a disc separation screen, and the method further comprising controlling the servicing unit to remove an obstruction from an interfacial opening on the disc separation screen.

10. The method of claim 7, wherein the reconfiguration instructions are to reconfigure the one or more MHUs such that the material waste stream is redirected to different MHUs of the plurality of MHUs to achieve load balancing among the plurality of MHUs.

11. The method of claim 7, further comprising controlling the plurality of MHUs to extract contaminants from the material waste stream and/or extract recyclable materials from the material waste stream.

12. The method of claim 7, further comprising implementing a machine learning or artificial intelligence model to perform the identification and classification of objects within the material waste stream based on the data streams; and perform the optimization of the purification and/or the recovery according to the identified and classified objects.

13. A control system to be employed in an autonomous data collection and control system in a material recovery facility (MRF), the control system comprising:

interface circuitry to communicatively couple the computing device to each of a plurality of MRF sensors and each of a plurality of material handling units (MHUs) disposed throughout the MRF, the interface circuitry configurable to obtain sensor data from respective MRF sensors of the plurality of MRF sensors; and processor circuitry communicatively coupled with the interface circuitry, the processor circuitry configurable to:

control the plurality of MHUs, via the interface circuitry, to purify and/or recover at least one recyclable material from a material waste stream at one or more locations within the MRF;

determine an MRF status based on a composition of the material waste stream at the one or more locations as indicated by the sensor data and an operating condition of at least one MHU of a plurality of MHUs;

identify and classify objects within the material waste stream based on the sensor data;

optimize purification and/or recovery operations performed by the plurality of MHUs based on the MRF status and the identified and classified objects; and reconfigure individual MHUs of the plurality of MHUs based on the optimization, wherein, to reconfigure the individual MHUs, the processor circuitry is configurable to retask the individual MHUs to recover a different selected material from the material waste stream.

14. The apparatus of claim 13, wherein the processor circuitry is further configurable to operate a machine vision system to perform the identification and classification of the objects.

15. The apparatus of claim 14, wherein the processor circuitry is configurable to control one or more MHUs of the plurality of MHUs to remove contaminants recognized by the machine vision system from the material waste stream; and control one or more other MHUs of the plurality of MHUs to extract recyclable materials recognized by the machine vision system from the material waste stream.

16. The apparatus of claim 14, wherein the processor circuitry is further configurable to operate a machine learning or artificial intelligence model to perform the optimization.

17. The apparatus of claim 13, wherein the processor circuitry is further configurable to operate a machine learning or artificial intelligence model adaptively control the individual MHUs based on the sensor data.

18. The apparatus of claim 17, wherein the processor circuitry is configurable to reconfigure the individual MHUs in real time to remove varying types of recyclable materials, direct the material waste stream to different MHUs of the plurality of MHUs to achieve load balancing among the plurality of MHUs, and/or retask one or more MHUs of the plurality of MHUs to purify and/or recover different types of materials from the material waste stream.

19. The apparatus of claim 13, wherein:

the plurality of HMUs include at least two different MHUs selected from a group comprising a conveyor, a mechanical sorter, a robotic sorter, an optical sorter, an air sorter, a baler sorter, and an automated quality control (AQC) sorter;

the one or more MRF sensors include one or more of an infrared (IR) light sensor, a near IR (NIR) spectrometer, an ultraviolet (UV) light sensor, an x-ray light sensor, a visible light sensor, a magnetometer, a chemical sensor, an inductive sensor, a load cell, a density sensor, a speed sensor, an inclinometer, a moisture sensor, a laser measurement device, a current sensor, a pressure transducer, and a flow meter; and the processor circuitry is one or more of a multi-core processor, an application-specific integrated circuit (ASIC), a field-programmable gate array (FPGA), a hardware accelerator, a digital signal processor, a crypto processor, or a graphics processor.

* * * * *